United States Patent [19]

Stanley

[11] 3,952,385

[45] Apr. 27, 1976

[54] STRAND TREATMENT APPARATUS

[75] Inventor: Robert K. Stanley, Media, Pa.

[73] Assignee: Textured Yarn Co., Inc., Kennett Square, Pa.

[22] Filed: July 5, 1973

[21] Appl. No.: 376,890

Related U.S. Application Data

[63] Continuation-in-part of Ser. Nos. 343,644, March 22, 1973, Pat. No. 3,840,950, and Ser. No. 124,213, March 15, 1971, Pat. No. 3,753,275, which is a continuation-in-part of Ser. No. 822,429, May 7, 1969, Pat. No. 3,570,083, which is a continuation-in-part of Ser. No. 678,428, Oct. 26, 1967, Pat. No. 3,462,814, and Ser. No. 302,758, July 31, 1963, Pat. No. 3,376,622.

[52] U.S. Cl. ..... 28/1.3; 28/1.4; 28/1.6

[51] Int. Cl.[2] ..... D02G 1/20; D02G 1/16; D02G 1/12

[58] Field of Search ..... 28/1.3, 1.4, 1.6, 72.11, 28/72.12, 72.14

[56] References Cited

UNITED STATES PATENTS

| | | | |
|---|---|---|---|
| 2,575,838 | 11/1951 | Rainard | 28/72.14 X |
| 2,914,835 | 12/1959 | Slayter et al. | 28/1.3 X |
| 3,046,633 | 7/1962 | Ohashi et al. | 28/1.6 |
| 3,298,079 | 1/1967 | Agett et al. | 28/72.14 |
| 3,343,240 | 9/1967 | Parmeggiani et al. | 28/72.14 X |
| 3,373,470 | 3/1968 | Joly | 28/1.3 X |
| 3,376,622 | 4/1968 | Stanley | 28/1.6 |
| 3,499,194 | 3/1970 | Schmick | 28/72.14 |
| 3,611,520 | 10/1971 | Faidley | 28/1.6 |
| 3,626,557 | 12/1971 | Chudgar et al. | 28/72.14 |
| 3,650,001 | 3/1972 | Nikkel | 28/1.3 X |

*Primary Examiner*—Louis K. Rimrodt
*Attorney, Agent, or Firm*—Charles A. McClure

[57] ABSTRACT

Textile strands are crimped by feeding them with nip rolls into and forwarding them by fluid jets within a laterally confining region terminating in a laterally surrounding fine screen. The resulting nip-jet stuffer-crimper is a new species of strand-crimping apparatus.

3 Claims, 3 Drawing Figures

STRAND TREATMENT APPARATUS

This application is a continuation-in-part of my copending applications Ser. No. 343,644 filed Mar. 22, 1973 now U.S. Pat. No. 3,840,950, granted Oct. 15, 1974, and Ser. No. 124,213 filed Mar. 15, 1971, now U.S. Pat. No. 3,753,275, granted Aug. 21, 1973, the latter being a continuation-in-part of Ser. No. 822,429 filed May 7, 1969 and now U.S. Pat. No. 3,570,083, itself a continuation-in-part of my prior applications, Ser. No. 678,428 filed Oct. 26, 1967 (now U.S. Pat. No. 3,462,814) and Ser. No. 302,758 filed July 31, 1963 (now U.S. Pat. No. 3,376,622).

This invention relates to stuffer-crimping of textile strands, especially with the aid of jetting such a strand to forward it within a laterally confining region and thereby compressively crimping it.

Numerous means and methods of bulking or crimping textile strands are well known, each with certain advantages and disadvantages, whether in operation or in product (or both). Mechanical deformation of strands by mechanical contact with gears or nip rolls often weakens the strands unduly, and jets have been used to forward strands for compressive crimping without causing such degradation. When enough jetting force is employed alone, however, the jetting fluid tends toward formation of loops or other configurations undesirable in compressively crimped strands.

A primary object of the present invention is longitudinally compressive crimping of textile strands without relying solely upon nip rolls or jets to propel the strand in the crimping region.

Another object is stuffer-crimping of textile strands without formation of undesired jet-induced strand configurations or degradation from excessive lateral compression.

A further object is provision of strand-crimping apparatus for accomplishing the foregoing objects.

Other objects of this invention together with means and method for attaining the various objects, will be apparent from the following description and the accompanying diagrams of a preferred embodiment thereof, which is presented by way of example rather than limitation.

In general, the objects of the present invention are accomplished, in textile strand-crimping apparatus comprising means laterally confining such strand and having an entrance portion and an exit portion, nip-roll means for feeding strand into the entrance portion, jet means downstream of the nip-roll means and adapted to forward the strand at least partially through the entrance portion, and wherein the exit portion comprises a laterally confining screen. Such apparatus may be termed a "nip-jet" stuffer-crimper.

Figure 1:
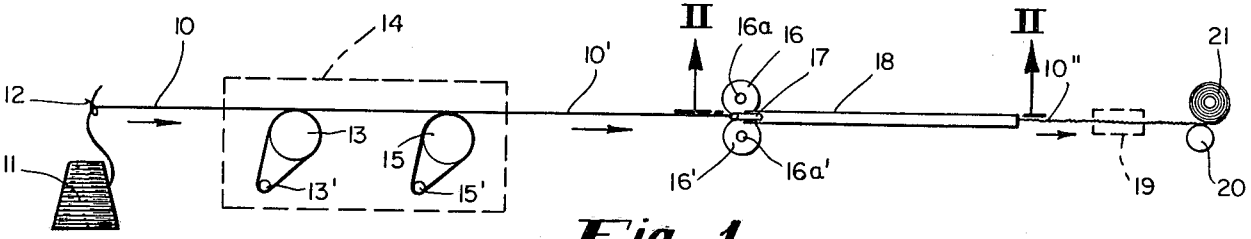
FIG. 1 is a schematic representation of strand treatment utilizing apparatus according to the present invention.

FIG. 1 shows strand 10 as being withdrawn from package 11 thereof and forwarded through guide 12 to first pair 13, 13′ and then second pair 15, 15′ of godet and separator rolls within enclosure 14. The enclosure may be heated, as may the godets themselves, which also may draw the strand therebetween to increased length. Upon leaving the enclosure, the strand (now designated 10′) passes through the nip of pair of rolls 16, 16′ mounted on axles **16*a*, 16*a*′, and into the entrance of nip-jet stuffer-crimper 18. Tube 17 (partly broken away) extends obliquely into the crimper wall and receives air thereinto and onto the strand just downstream of the roll nip. Crimped strand 10″ is withdrawn lengthwise from the exit end of the crimper through region 19, in which it is adjusted in tension, speed, or temperature (or a combination thereof) and then is shown as being wound into package 21 by drive roll 20,** which may be slotted helically to traverse the strand onto the package.

Figure 2:
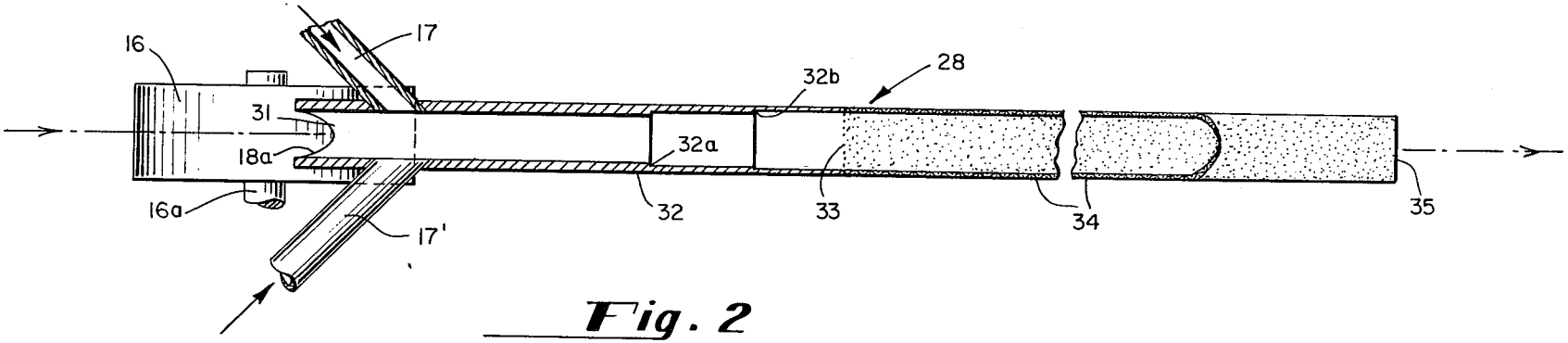
FIG. 2 is an enlarged side elevation, largely in section along II—II in FIG. 1, of certain of such apparatus, less the strand shown in that preceding view.

FIG. 2 shows nip-jet stuffer-crimper 18 of the preceding view in greater detail, including tubular entrance portion 31, exit portion 34, and intermediate portion 32 joining the entrance and exit portions. Feed roll 16 protruding leftward beyond beveled end 18a of the entrance portion, which is beveled to fit within the bight of the rolls, nearly to the nip, is visible because roll 16′ is absent from this view. Extending obliquely to one another and to the downstream direction of strand travel are pair of fluid inlet tubes 17, 17′ communicating with entrance portion 31 at angles of about 30° below and above the horizontal immediately downstream from the entrance end. As shown, the pair of jet nozzles are disposed in a medial plane including the roll nip.

The bore of the intermediate portion of chamber 28 is stepped outwardly in the downstream direction (to the right) at **32*a* and 32*b*, while exit portion 34 is smoothly cylindrical with small openings therethrough (indicated here by stippling) throughout its length, from junction 33 with the intermediate portion to chamber outlet 35. The exit portion is screenlike in function and structure and sometimes is called a "screen" herein notwithstanding that it may or may not be woven in form and that it is impractical to show a very fine-mesh woven form in the drawing. The strand shown in FIG. 1 is omitted from FIG. 2** in the interest of clarity but is shown again in the fragmentary enlarged view following.

Figure 3:
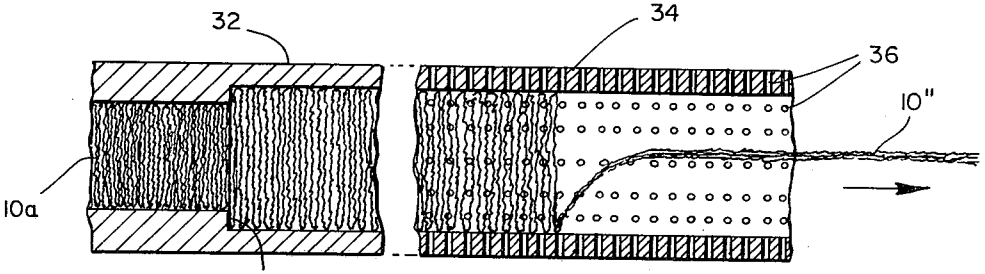
FIG. 3 is a fragmentary view of part thereof with the strand in place, on a further enlarged scale.

FIG. 3 shows part of stuffing chamber intermediate portion 32 and exit portion 34. Compact strand accumulation **10*a* fills the former but only partially fills the latter, from which crimped strand 10″ is withdrawn longitudinally. Openings 36** through the wall of the exit portion from the interior to the exterior are visible (not necessarily drawn to scale) in this view.

Operation of the illustrated apparatus in the practice of the present invention is readily understood. Textile strand 10 is withdrawn from package 11 or any other suitable source of supply of such strand and is passed through guide 12 or other appropriate guide, which imposes some degree of tension. Input godet and separator roll pair 13, 13′ about which the strand passes in essentially non-slipping contact, establish a given input speed, which is normally exceeded by the speed of output godet and separator roll pair 15, 15′ about which the strand passes similarly. In the event of a sufficient disparity between input and output speeds the strand is drawn to increased length, for which a ratio of 4× is customary in the treatment of nylon strands, for example. Crimping preferably follows closely after drawing.

The rate at which resulting strand 10′ enters nip-jet stuffer-crimper 18 is at least the rate at which it leaves the output godet and separator roll pair and preferably is higher. At least one of nip rolls 16, 16' is driven, and the surface speed thereof is regulated relative to that of output draw roll 15, by conventional means (not shown), much as the speed of the output draw roll is controlled relative to that of the input draw roll, but with a lesser degree of underfeed in the downstream direction.

At greater than about ten percent roll overspeed, corresponding to strand underfeed, the strands probably will be drawn to further increased length, unless a maximum draw for the particular strand composition already had been imposed, and such further draw may equal or even exceed the previous draw if desired. It is preferred, although not necessary, that the strands not have been drawn significantly at a remote previous time, although appreciable benefit from the present invention may be attained if such previous draw did not exceed about half the total drawability of the undrawn material, thereby leaving it still substantially drawable. It is preferred to limit the degree of underfeed from rolls 15, 15' to the crimper to at most half the total drawing underfeed, or usually to not much more than about 200%. A range of from about 5 to 50% underfeed is preferred when little or no added draw is desired, and a range of from about 100 to 200% when substantial added draw is desired at the crimper input.

Air at superatmospheric pressure enters through tubes 17, 17' of the air jet means, then entrains and forwards (or at least assists in forwarding) the infed strand into and through entrance portion 31 of chamber 28 in which it is compacted into accumulation 10*a* of crimped strand. The inside wall of the entrance portion of the chamber is smoothly cylindrical and imperforate, the intermediate portion is stepped cylindrical and imperforate, and the exit portion is perforate but otherwise smoothyl cylindrical. As shown, the intermediate portion is preferably multiply stepped outward in the downstream direction. In addition thereto or instead thereof it may be tapered similarly. Transition steps or taper may occur at the junctions of succeeding portions with one another and at the outlet end of the exit portion. The propelling air pressure is relieved gradually by such increasing cross-section of the chamber bore and further by escaping in a sort of diffusion through the sidewall openings in exit portion 34 as well as flowing out the outlet 35 thereof.

Openings 36 from the interior to the exterior of exit portion 34 of the stuffing chamber are shown as small radial bores through the wall thereof. As indicated above, such a structure is considered to be a screen, in view of the fineness of the openings. Of course, a similarly fine woven screen is suitable also. A representative 60 mesh screen useful according to this invention has wire and opening widths of 0.008 or 0.009 inch, and the openings comprise about 30% of the screen area. A surface with such fine openings appears to have an overall matte finish rather than discrete openings therein.

Suitable means and methods for heating the strand, as in enclosure 14, are set forth in U.S. Pat. No. 3,559,254 and my prior patents recited therein. Appropriate tensioning means are set forth in my U.S. Pat. No. 3,317,977 and its predecessor. Stuffing chambers for use according to this invention preferably are of open-ended type as disclosed in U.S. Pat. No. 3,570,084. and my prior patents identified therein, albeit with dissimilar infeed means. For drawing means, see U.S. Pat. No. b 3,570,083 and its predecessors in my name. Means for withdrawing crimped strand from the chamber and through the aftertreating enclosure have been shown schematically and may be wholly conventional.

The nip-jet stuffer-crimper of this invention not only provides a novel combination of structural characteristics but also functions to produce crimped textile strands having superior qualities of handle, cover, and structural crimp characteristics. Such crimped strands are free of undesired degradation and loops. Although a preferred embodiment has been described and illustrated, modifications may be made therein, as by addition, combination, or subdivision of parts or steps, or by substitution of equivalents, while retaining significant advantages and benefits of the invention, which itself is defined in the following claims.

I claim:

1. Apparatus for crimping textile strands, comprising nip roll feed means for engaging a textile strand and feeding it into stuffing chamber means located downstream of the roll means for laterally confining the textile strand temporarily, a plurality of jet means flanked at least in part by the roll means at the entrance end of the chamber for applying fluid obliquely in the downstream direction to the strand, and a screen surrounding the strand laterally at the exit end of the chamber.

2. apparatus for crimping textile strands, comprising a pair of nip rolls for receiving a textile strand therebetween and forwarding it in the downstream direction, a plurality of fluid jets located at least partially between the downstream surfaces of the rolls and oriented to apply fluid obliquely against the strand in the downstream direction, and a stuffing chamber having its entrance end in communication with the jet outlets.

3. Strand-crimping apparatus according to claim 2, wherein the stuffing chamber has a straight-through bore and having a fine screen terminating the exit end of the stuffing chamber in open-ended straight tubular configuration.

* * * * *